US006105166A

United States Patent [19]

Thomas, III et al.

[11] Patent Number: 6,105,166

[45] Date of Patent: Aug. 22, 2000

[54] COLLAR GUARD SYSTEM

[76] Inventors: Johnnie Thomas, III, 2813 Mill Lake Way, Morrow, Ga. 30260; Karen C. Whylie, 80 Lakefront Dr., Covington, Ga. 30016

[21] Appl. No.: 09/100,078

[22] Filed: Jun. 19, 1998

[51] Int. Cl.[7] ..... A41D 27/16

[52] U.S. Cl. ..... 2/60; 2/132

[58] Field of Search ..... 2/60, 46, 53, 63, 2/129, 131, 132, 134, 135, 136, 139, 143, 174

[56] References Cited

U.S. PATENT DOCUMENTS

| | | | |
|---|---|---|---|
| 639,213 | 12/1899 | Clevenstine | 2/60 |
| 2,116,685 | 5/1938 | Nicolet | 2/60 |
| 2,634,420 | 4/1953 | Jackson | 2/60 |
| 3,200,413 | 8/1965 | Vaughan | 2/60 |
| 4,008,494 | 2/1977 | Hicks | 2/60 |
| 4,653,119 | 3/1987 | Kaiser | 2/60 |
| 4,980,927 | 1/1991 | Wawiluk et al. | 2/60 |
| 5,711,030 | 1/1998 | Anderson et al. | 2/60 |

FOREIGN PATENT DOCUMENTS

| | | | |
|---|---|---|---|
| 1222354 | 6/1987 | Canada | 2/60 |

*Primary Examiner*—Amy Vanatta

[57] ABSTRACT

A new collar guard system for preventing shirt collars from being soiled, thus reducing cleaning bills and extending the life of shirts. The inventive device includes a first layer of water impervious material with an adhesive on one side for attaching the layer to the collar of a shirts. A second layer of non-woven, moisture absorbent material is attached to the first layer for absorbing moistures from the user's neck. A tapered spacer member is attached to the second layer so as to slightly space the second layer from the user's skin. The first layer, second layer, and spacer member can be disposed within a washable fabric protective cover so as to form a core thereof. A slot is provided on the cover through which the core can be inserted and removed, and a tab is attached to the core so as to facilitate insertion and removal of the core.

15 Claims, 4 Drawing Sheets

COLLAR GUARD SYSTEM

BACKGROUND OF THE INVENTION

1. Field of the Invention

The present invention relates to collar protectors and more particularly pertains to a new collar guard system for preventing shirt collars from being soiled, thus reducing cleaning bills and extending the life of shirts.

2. Description of the Prior Art

The use of collar protectors is known in the prior art. Known prior art collar protectors include U.S. Pat. No. 4,653,119; U.S. Pat. No. 4,008,494; U.S. Pat. No. 4,190,903; U.S. Pat. No. 4,980,927; U.S. Pat. No. 4,953,232; U.S. Pat. No. 5,575,410; U.S. Pat. No. 5,453,296; U.S. Pat. No. 5,360,148; U.S. Pat. No. 3,860,967; U.S. Pat. No. 3,832,737; U.S. Pat. No. 3,200,413; U.S. Pat. No. 2,634,420; U.S. Pat. No. 2,182,582; U.S. Pat. No. 3,022,514; U.S. Pat. No. 4,989,269; U.S. Pat. No. 4,333,980; U.S. Pat. No. 2,164,751; U.S. Pat. No. 2,140,249; U.S. Pat. No. 2,637,034; and U.S. Pat. No. 2,633,576.

While these devices fulfill their respective, particular objectives and requirements, the aforementioned patents do not disclose a new collar guard system. The inventive device includes a first layer of water impervious material with an adhesive on one side for attaching the layer to the collar of a shirt. A second layer of non-woven, moisture absorbent material is attached to the first layer for absorbing moisture from the user's neck. A tapered spacer member is attached to the second layer so as to slightly space the second layer from the user's skin. The first layer, second layer. and spacer member can be disposed within a washable fabric protective cover so as to form a core thereof. A slot is provided on the cover through which the core can be inserted and removed, and a tab is attached to the core so as to facilitate insertion and removal of the core.

In these respects, the collar guard system according to the present invention substantially departs from the conventional concepts and designs of the prior art, and in so doing provides an apparatus primarily developed for the purpose of preventing shirt collars from being soiled, thus reducing cleaning bills and extending the life of shirts.

SUMMARY OF THE INVENTION

The general purpose of the present invention, which will be described subsequently in greater detail, is to provide a new collar guard system which has many of the advantages of the collar protectors mentioned heretofore and many novel features that result in a new collar guard system which is not anticipated, rendered obvious, suggested, or even implied by any of the prior art collar protectors. either alone or in any combination thereof.

To attain this, the present invention generally comprises a first layer of water impervious material with an adhesive on one side for attaching the layer to the collar of a shirt. A second layer of non-woven, moisture absorbent material is attached to the first layer for absorbing moisture from the user's neck. A tapered spacer member is attached to the second layer so as to slightly space the second layer from the user's skin. The first layer, second layer, and spacer member can be disposed within a washable fabric protective cover so as to form a core thereof. A slot is provided on the cover through which the core can be inserted and removed, and a tab is attached to the core so as to facilitate insertion and removal of the core.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is therefore an object of the present invention to reduce and eliminate the soiling of shirt collars. A further object of the present invention is to save consumers money by reducing laundering of the shirt collars. It is an even further object of the present invention to extend the useful life of garments having collars, thus saving even further on clothing costs. It is an additional object of the invention to provide a protector which is inexpensive to use, and which can be repeatedly used.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

With reference now to the drawings, and in particular to FIGS. 1 through 3 and 7 thereof, a new disposable collar guard system embodying the principles and concepts of the present invention will be described.

Figure 7:
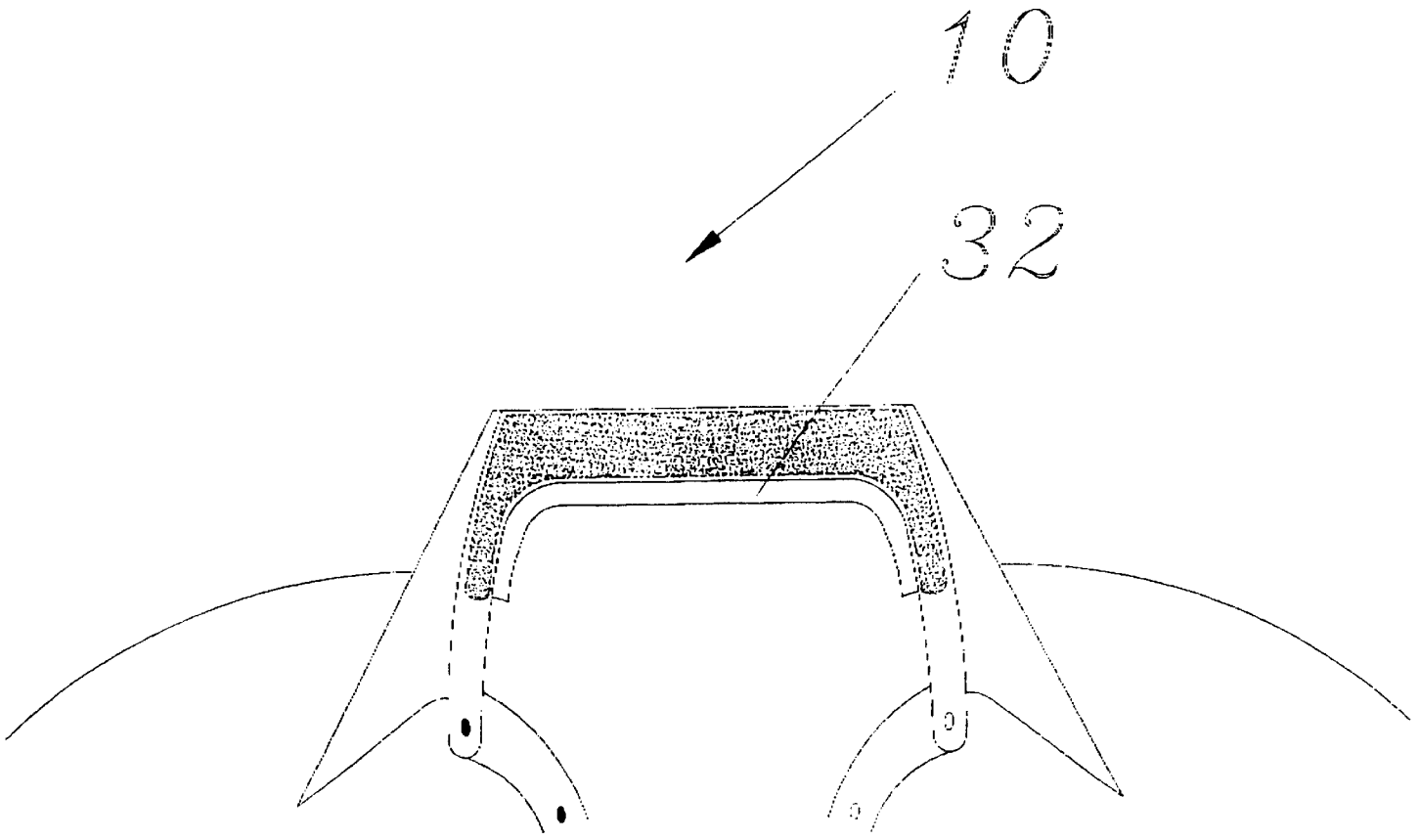
FIG. 7 is a view showing the disposable guard attached to a shirt collar.

As best illustrated in FIGS. 1 through 3 and 7, the disposable collar guard system 10 comprises a first layer or strip 12 of water impervious material which has a conventional pressure sensitive adhesive on one side thereof for attaching the strip to a collar of a shirt or other garment as shown in FIG. 7. A removable, peel-off cover 13 is disposed over the adhesive which is removed before use to expose the adhesive. The strip 12 includes an extended bottom portion 18 for providing additional securement to the shirt collar, and an extended, curved upper portion 19 which covers the top edge of the collar when properly attached thereto.

Figure 3:
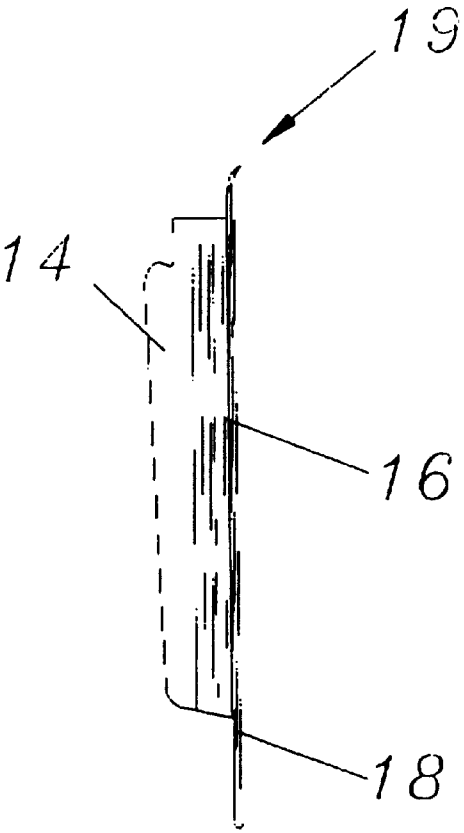
FIG. 3 is a side view of the disposable collar guard.

Further, a second layer or core 16 is attached along one side thereof to the strip 12. The layer 16 is made of a non-abrasive, non-allergenic, non-woven, moisture absorbent material to absorb moisture from the users neck. The moisture absorbent material can comprise an absorbent charcoal. wood pulp, or a hydrophilic polyurethane material suitably formed into a solid layer. In order to space the layer 16 from direct contact with the users skin, a spacer member 14 is attached along one side thereof to the layer 16 so that the layer 16 is disposed between the member 14 and the strip 12. As seen in FIG. 3, the spacer member 14 is tapered so that its thickness decreases from adjacent its top edge to its bottom edge thus creating an area of space that begins from the base of the neck and stops about ¼ up the side of the strip 12. Thus a small gap is created between the skin and the layer 16 that will increase the protection to the shirt preventing the edge of the collar from getting soiled.

As seen in FIG. 7, the system 10 is used by first removing the peel-off strip 13 and then using the exposed adhesive to secure the system to the inside of the shirt collar. The layer 12 can include a further extension 32 at its bottom edge to more firmly secure the disposable system to the collar. After use of the system, it is simply removed by peeling the system from the collar and discarded for replacement by a new guard system.

Figure 1:
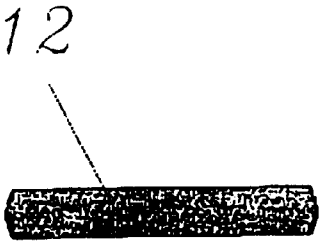
FIG. 1 is a front view of a disposable collar guard.
Figure 2:
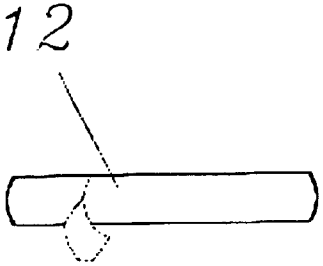
FIG. 2 is a rear view of the opposite side of the collar guard shown in FIG. 1.
Figure 4:
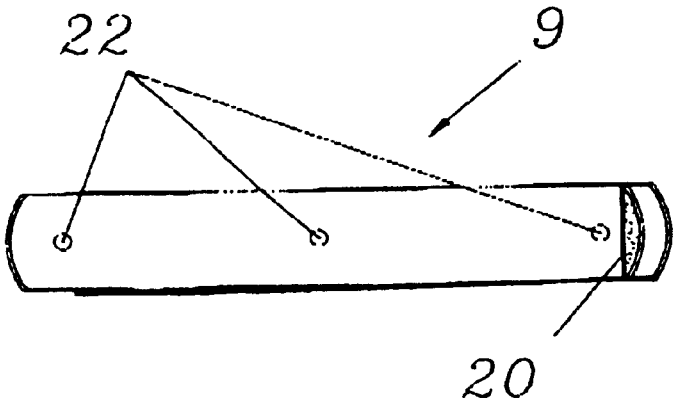
FIG. 4 is a rear view of a reusable protective cover.
Figure 5:
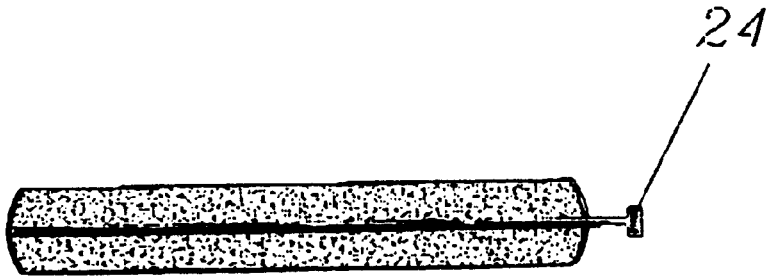
FIG. 5 is a front view of a core used with the protective cover of FIG. 4.

A reusable system is shown in FIGS. 4–6 and 8, which utilizes the layer 12, the layer 16, and the spacer member 14 of FIGS. 1–3, but additionally employs a washable, protective cover 9 into which the guard system of FIGS. 1–3 is disposed so as to form an absorbent core. The cover 9 is made of a fabric material generally of the same type which is used to form the shirt and collar, and which has the same color as the shirt and collar. The cover 9 includes a slot 20 adjacent one end through which the core can be inserted and removed. The cover 9 further includes the male portions 22 of snap fasteners which engage with corresponding female portions 30 of the snap fasteners which are located on the collar for securing the cover to the collar. Thus the cover 9 can be easily attached to and removed from the collar by engaging and disengaging the corresponding male and female portions 22, 30 of the snaps.

Figure 6:
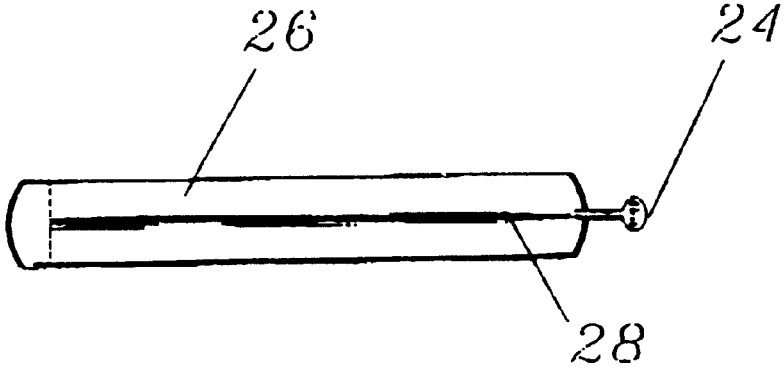
FIG. 6 is a rear view of the core of FIG. 5.

To facilitate insertion and removal of the core from the cover 9, a pull tab 24 is attached to one of the layers 12,16 or the spacer 14, to permit a user to easily grasp the core for insertion and removal through the slot 20. FIG. 6 illustrates the pull tab 24 attached to the opposite side of the core from a that shown in FIG. 5. In this instance, the core includes a peel-off cover 26, similar to the peel-off cover 13, but which is formed in two pieces. One small piece is located at the far end of the core, while the body 28 of the tab 24 is attached to the second piece. The small piece is peeled off first nd the core inserted into the cover 9 using the tab 24. Once in, the tab 24 is pulled so as to peel away the second piece thus exposing the adhesive for securing the core within the cover 9.

Figure 8:
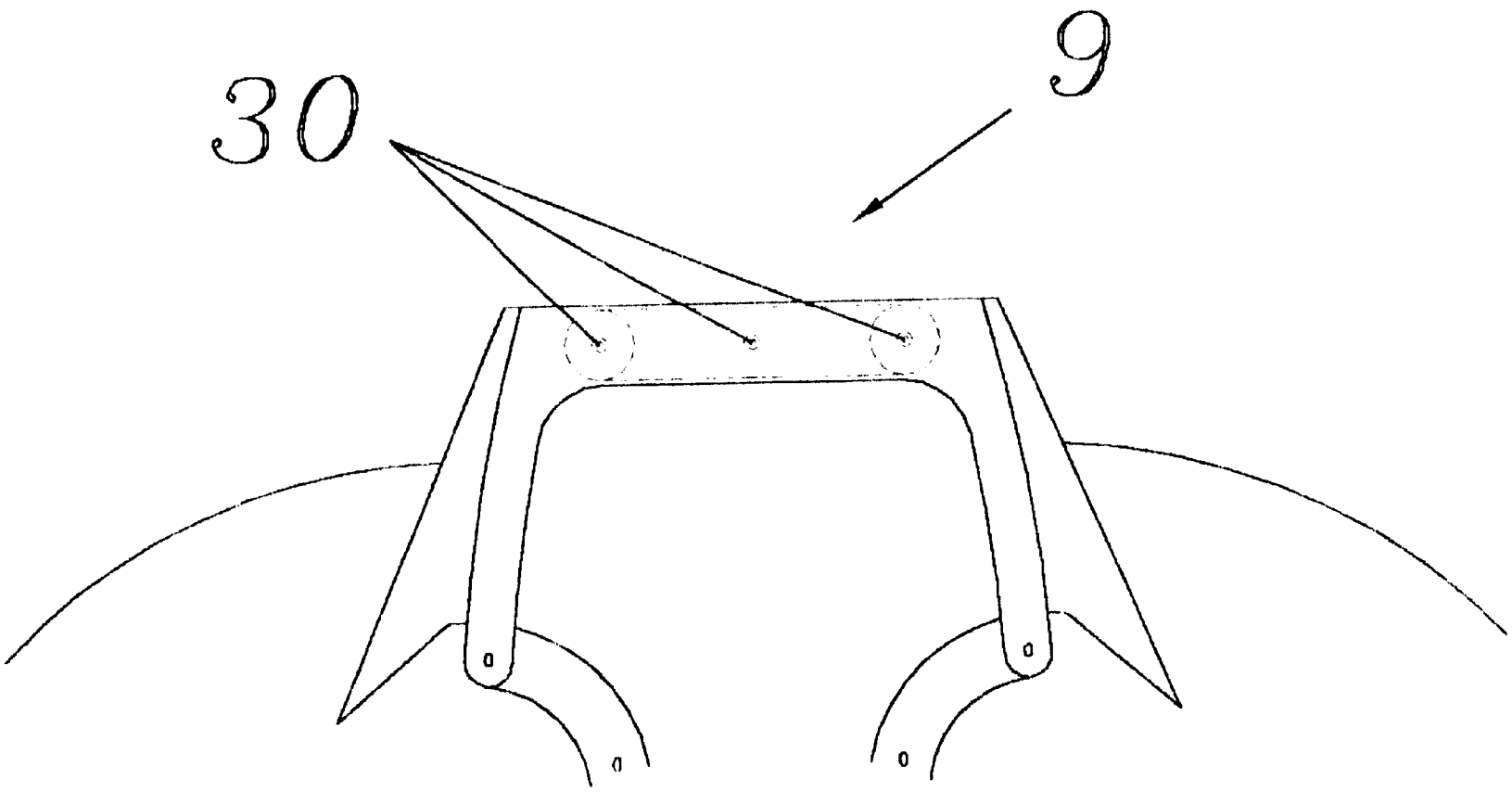
FIG. 8 is a view showing the reusable protective cover and core attached to a shirt collar.

As seen in FIG. 8, once the core is properly inserted into the cover, the cover is attached to the collar using the snaps 22,30. Thus the system is securely located in the proper place on the collar. Once soiling occurs, the snaps are simply undone and the core removed from the cover. allowing the cover to be washed. After washing, the old core, or a new core if desired, is inserted into the cover, and the cover reattached to the collar for further use.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials shape, form, function and manner of operation, assembly and use, are deemed readily apparent and obvious to one skilled in the art, and all equivalent relationships to those illustrated in the drawings and described in the specification are intended to be encompassed by the present invention.

I claim:

1. A collar protector for protecting a collar of a garment, comprising:

a first layer of water impervious material having a first side and a second side;

a second layer attached to the first side of said first layer, said second layer being made of a non-woven, moisture absorbent material; and a spacer member attached to said second layer such that said second layer is disposed between the first layer and the spacer member.

2. The collar protector according to claim 1, wherein said non-woven, moisture absorbent material comprises one of an absorbent charcoal, wood pulp, and hydrophilic polyurethane.

3. The collar protector according to claim 1, wherein said spacer member is coextensive with said second layer.

4. The collar protector according to claim 1, wherein said spacer member includes a top edge and a bottom edge, said spacer member tapering in thickness from the top edge to the bottom edge.

5. The collar protector according to claim 4, wherein the thickness of said spacer member decreases from the top edge to the bottom edge.

6. The collar protector according to claim 1, wherein said second side of the first layer includes a pressure sensitive adhesive thereon for attaching the protector to the garment collar.

7. The collar protector according to claim 6, further including a removable strip disposed over the adhesive.

8. The collar protector according to claim 1, wherein said first layer includes a top edge and a bottom edge, and said bottom edge extends below a bottom edge of the second layer.

9. The collar protector according to claim 8, wherein said top edge extends above a top edge of the second layer.

10. The collar protector according to claim 1, wherein said first layer, said second layer, and said spacer member are removably disposed within a protective cover.

11. The collar protector according to claim 10, wherein said protective cover is made from a fabric material.

12. The collar protector according to claim 10, wherein said protective cover includes a slot adjacent one end thereof through which the first layer, the second layer, and the spacer member can be inserted and removed.

13. The collar protector according to claim 10, further including means for connecting the cover to the garment collar.

14. The collar protector according to claim 13, wherein said connecting means comprises a plurality of snap fasteners.

15. The collar protector according to claim 12, further including a pull tab connected to one of the first layer, the second layer, and the spacer member to facilitate insertion and removal through the slot of the protective cover.

* * * * *